US005735006A

United States Patent [19]

Vande Haar

[11] Patent Number: 5,735,006

[45] Date of Patent: Apr. 7, 1998

[54] WASHING MACHINE PULLEY AND FLUID RING

[75] Inventor: Evan R. Vande Haar, Pella, Iowa

[73] Assignee: Maytag Corporation, Newton, Iowa

[21] Appl. No.: 659,170

[22] Filed: Jun. 5, 1996

[51] Int. Cl.[6] ..... D06F 37/22

[52] U.S. Cl. ..... 8/158; 68/23.2; 74/572; 74/573 R; 74/573 F; 74/574

[58] Field of Search ..... 68/23.2; 8/158; 210/144, 364; 494/82; 74/572, 573 R, 573 F, 574

[56] References Cited

U.S. PATENT DOCUMENTS

| | | | |
|---|---|---|---|
| 3,330,168 | 7/1967 | Kahn | 74/573 |
| 3,462,198 | 8/1969 | Onufer | 301/5 |
| 3,494,471 | 2/1970 | Grippo | 210/363 |
| 4,019,396 | 4/1977 | Frechette | 74/572 X |
| 4,050,195 | 9/1977 | Hofmann | 74/573 F X |
| 5,139,120 | 8/1992 | Gomi | 74/574 X |
| 5,140,868 | 8/1992 | Mizuno et al. | 74/572 X |
| 5,345,792 | 9/1994 | Farrington et al. | 68/23.2 |

FOREIGN PATENT DOCUMENTS

| | | | |
|---|---|---|---|
| 248739 | 10/1990 | Japan | 74/573 F |
| 1 598 399 | 9/1981 | United Kingdom . | |

*Primary Examiner*—Philip R. Coe

*Attorney, Agent, or Firm*—Zarley, McKee, Thomte, Voorhees, & Sease

[57] ABSTRACT

An improved clothes washing machine is provided with a one-piece pulley and fluid balance ring. The fluid ring is integrally formed with the pulley and is cantilevered from the pulley. The fluid ring is thus in an offset vertical plane relative to the belt track of the pulley so as to prevent interference with the pulley belt. The fluid ring includes a plurality of concentric annular fluid chambers each of which are partially filled with fluid to provide a counterbalance to an unbalanced load of clothes in the washing machine. In an alternative embodiment, the fluid ring is integrally formed with the pulley and spaced radially inwardly from the pulley belt track.

15 Claims, 5 Drawing Sheets

WASHING MACHINE PULLEY AND FLUID RING

BACKGROUND OF THE INVENTION

Clothes washing machines commonly are provided with a fluid ring to correct or counterbalance unbalanced loads during the spin and wash operations. The fluid rings are normally mounted at the top edge of a vertical axis drum or the front edge of a horizontal axis drum with a front access opening. Other prior art washing machines include fluid balance rings along the side wall of a vertical access drum (U.S. Pat. No. 3,494,471), or around the perimeter of the end walls of a horizontal access drum having an access opening in the cylindrical side wall (U.S. Pat. No. 5,345,792). Balance rings have also been provided near the rear wall of a horizontal access drum (U.S. Pat. No. 3,330,168).

One objective in all known prior art fluid balance rings is to space the ring radially a maximum distance from the rotational axis of the drum so as to obtain the maximum counterbalance effect. In such prior art devices, the fluid ring is a separate component which is attached to the drum or the rotating drive shaft of the drum in various ways. Such construction increases the manufacturing costs, due to the multiple components and assembly thereof.

Another objective in counterbalancing devices is to space the counterbalancing ring axially a maximum distance from the pivot point of the drum. The pivot point is typically the bearing support. By extending axially a maximum distance, the effect of the counterbalance is maximized. While prior art devices commonly mount to the open end of the drum, this leaves the rear of the drum without any counter balancing mechanism.

Therefore, a primary objective of the present invention is the provision of an improved fluid ring for washing machines.

Another objective of the present invention is the provision of a fluid ring formed integrally with the drive pulley of a washing machine.

Another objective of the present invention is the provision of a washing machine drive pulley and fluid ring having a one-piece molded construction.

Another objective of the present invention is the provision of a fluid ring cantilevered from the drive pulley of a washing machine which counterbalances an unbalanced load during the operation of the machine.

SUMMARY OF THE INVENTION

An integrally formed pulley and fluid ring is provided for a clothes washing machine to balance unbalanced loads during the operation of the machine. The washing machine includes a conventional drum rotatably mounted in a cabinet. A shaft extends axially from the drum and defines the axis of rotation for the drum. A motor with a rotatable drive shaft is mounted in the cabinet.

The pulley and fluid ring combination of the present invention is mounted on the drum shaft and drivingly connected to the motor by a pulley belt. The fluid ring is cantilevered from the pulley so as to be offset, and thereby avoid any interference with the pulley belt. The fluid ring is formed integrally with the pulley, and includes a plurality of concentric annular chambers. A lid is sealingly mounted or welded to the fluid chamber to retain the fluid therein.

DETAILED DESCRIPTION OF THE DRAWINGS

Figure 1:
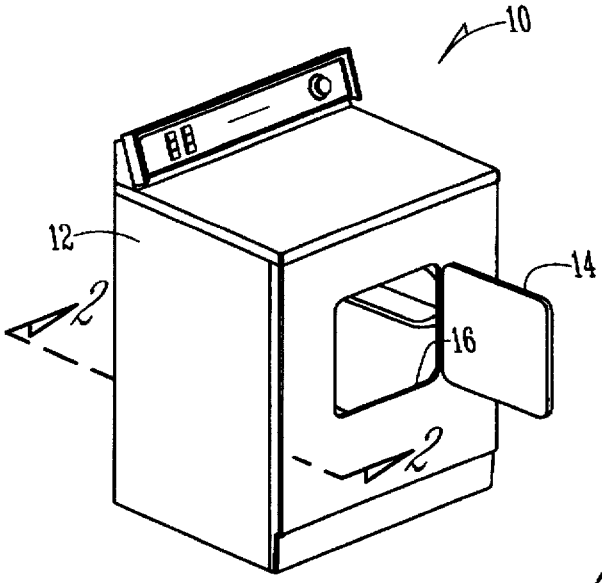
FIG. 1 is a perspective view of a horizontal axis washing machine.
Figure 2:
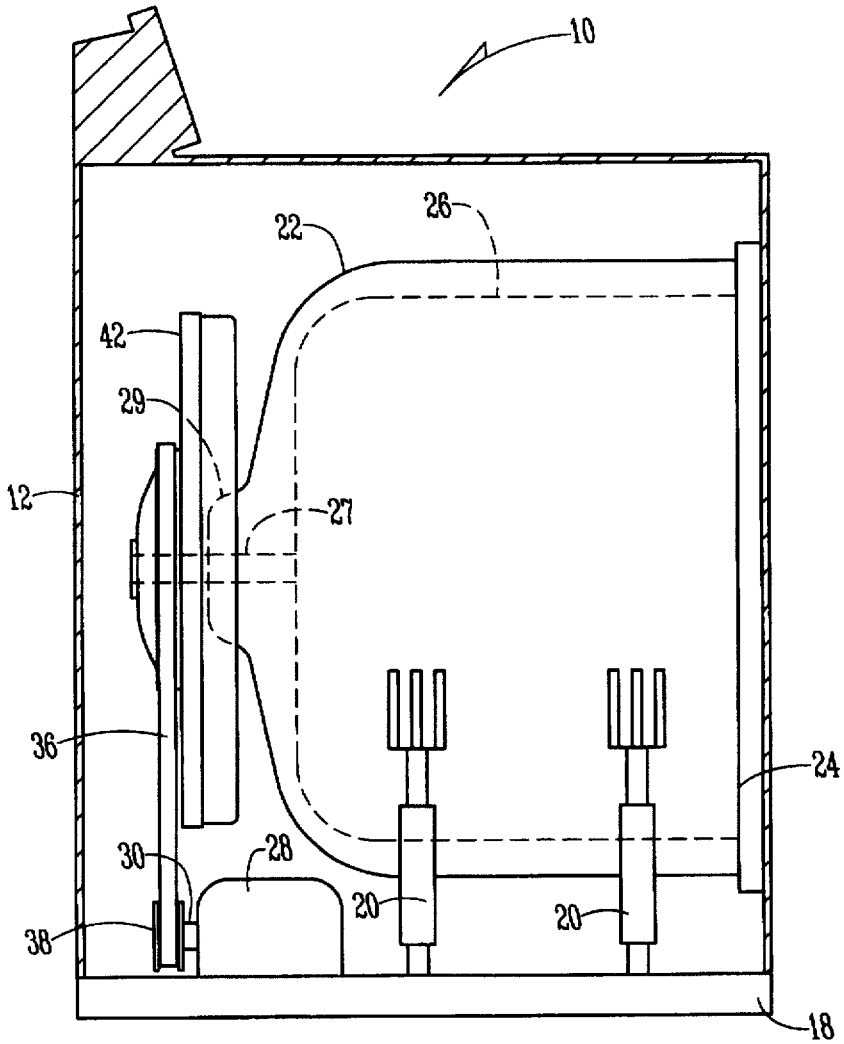
FIG. 2 is a sectional view taken along lines 2—2 of FIG. 1 and showing a first embodiment of the combined pulley and fluid ring of the present invention.
Figure 3:
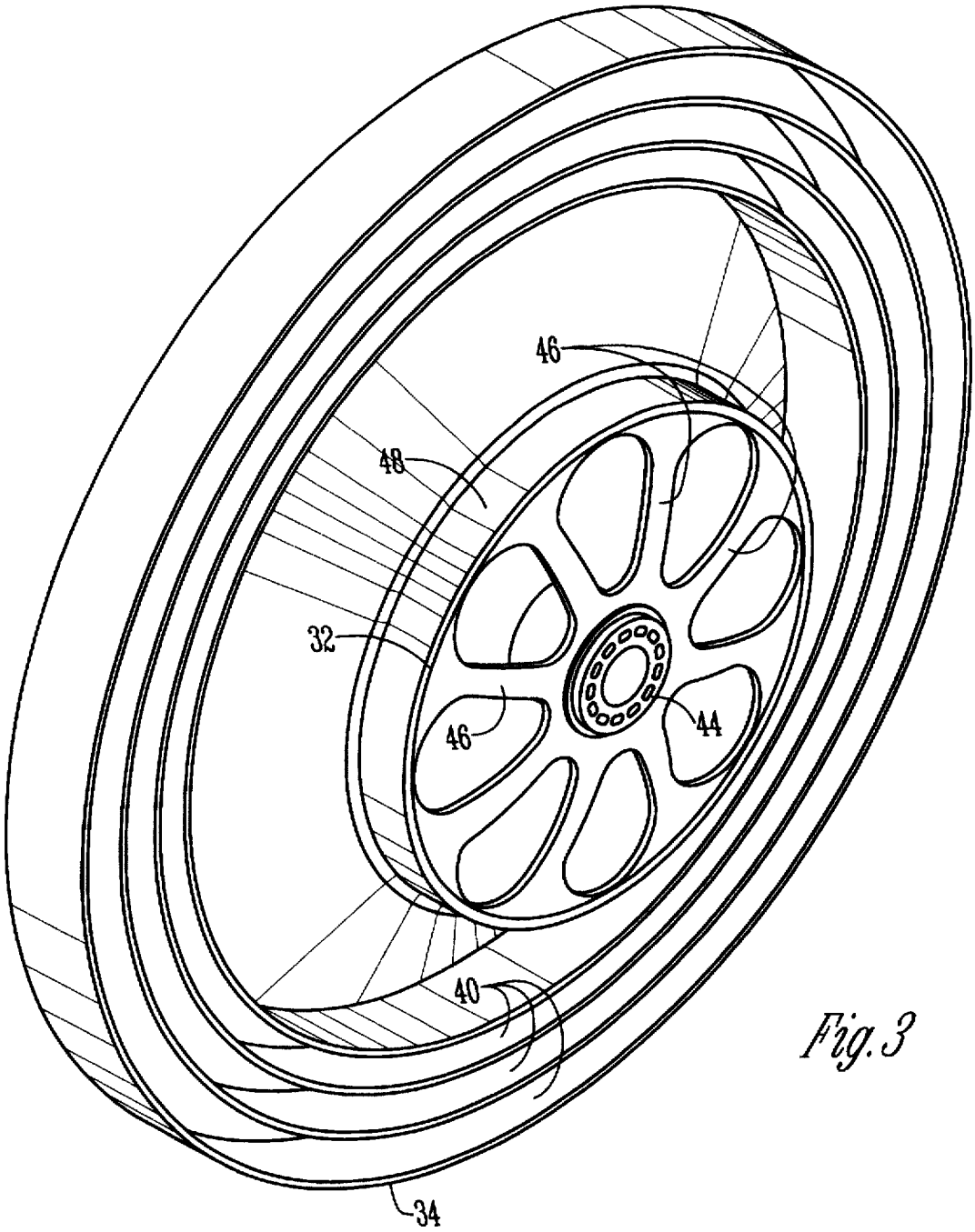
FIG. 3 is a perspective view of the pulley and fluid ring.
Figure 6:
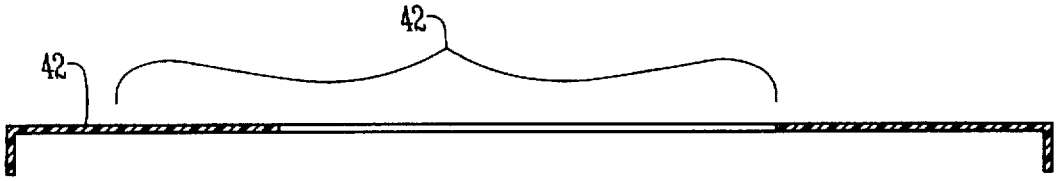
FIG. 6 is a sectional view of the fluid ring lid.

A horizontal washing machine is generally designated by the reference numeral 10 in the drawings. The washing machine 10 includes a cabinet 12 with a door 14 movable between open and closed positions relative to a front opening 16. The base 18 of the washing machine includes a plurality of struts or supports 20 for supporting a tub 22 within the cabinet. A perforated drum 26 is rotatably mounted within the tub 22 and has an open forward end through which clothes are placed into the drum and removed therefrom. A water tight seal is provided between the perimeter edge 24 of the tub 22 and the door 14 when the door is in the closed position. Water inlet and outlet lines (not shown) are operatively connected to the tub 22 so that wash and rinse water can be supplied to the clothes in the drum 26 and drained from the tub 22. During the operation of the machine 10, the water in the tub 22 never rises to a level above the access opening 16 in the cabinet 12. The water tight seal between the tub 22 and the door 14 prevents splash out of water. A motor 28 is mounted in the cabinet 12, and includes a drive shaft 30 for imparting rotation to the drum 26, as described further below. The drum 26 is mounted on a rotational support shaft 27, which is journalled within bearings 29 in the rear of the tub 22, as seen in FIG. 2.

The components of the washing machine 10, as described above, are conventional and do not constitute a part of the present invention.

The present invention is directed towards a combination pulley and fluid ring. More particularly, a driven pulley 32 is integrally formed through one-piece molded construction with a fluid ring 34. The pulley 32 is driven by a belt 36 trained about the pulley 32 and a pulley 38 on the drive shaft 30 of the motor 28. By forming the fluid ring 34 integrally with the pulley 32, the fluid ring 34 can be maintained a maximum axial extension from the bearings 29.

Figure 5:
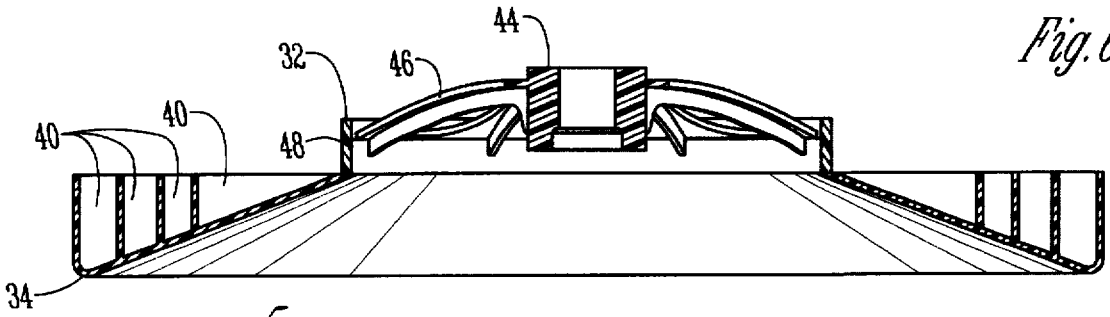
FIG. 5 is a sectional view taken along lines 5—5 of FIG. 4.
Figure 4:
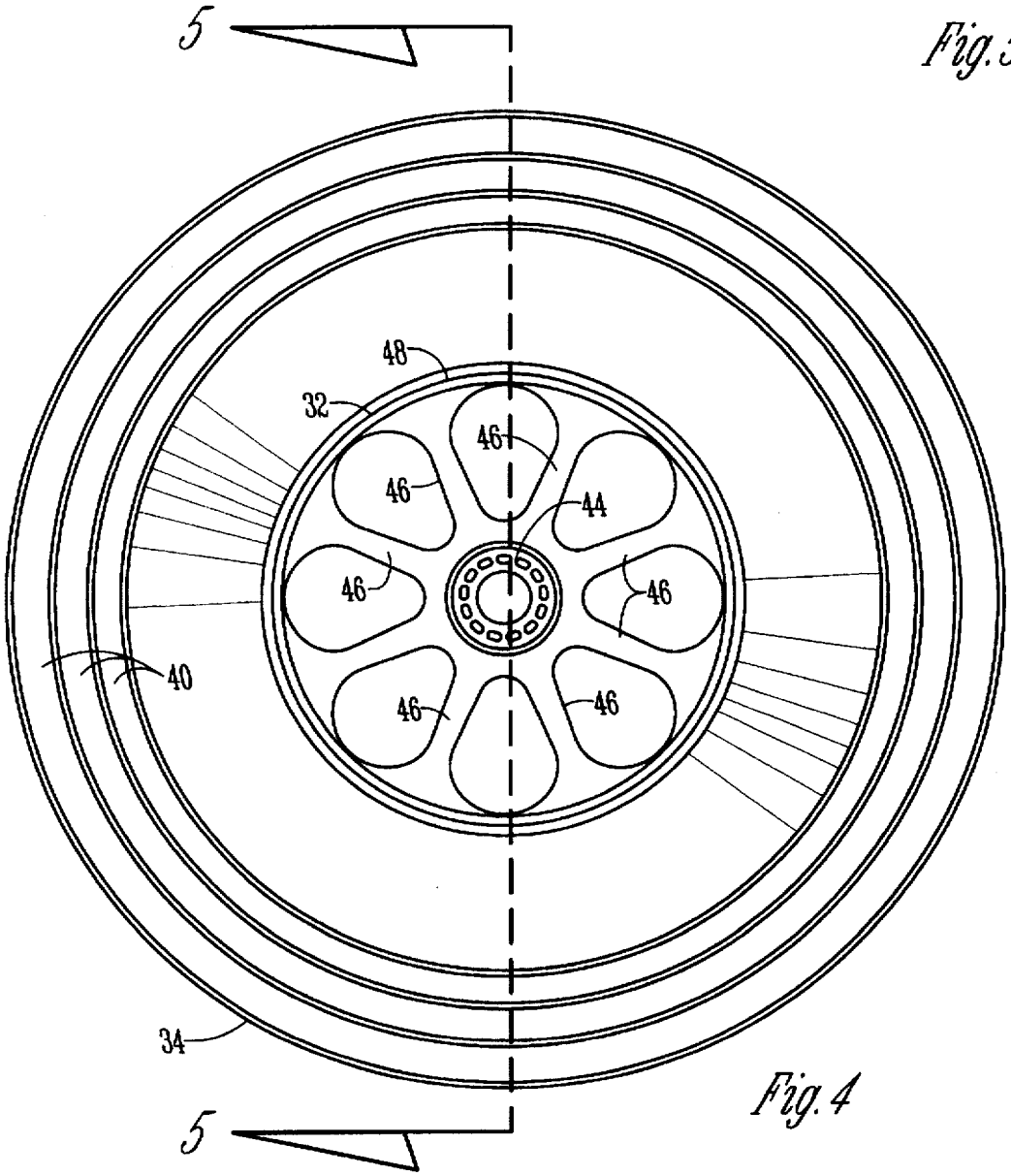
FIG. 4 is a front elevation view of the pulley and fluid ring.

The fluid ring 34 extends radially and axially from the pulley 32. As best seen in FIGS. 2 and 5, the fluid ring 34 is cantilevered forwardly from the pulley 32 so as to be offset therefrom. Thus, the fluid ring 34 does not interfere with the pulley belt 36.

The fluid ring 34 includes a plurality of concentric annular chambers 40, each of which are partially filled with a fluid. A lid or cover 42 is sealingly mounted over the chambers 40 by plastic welding or other convenient means. The lid 42 includes a central opening 43 to fit over the pulley 32.

The pulley 32 includes a central hub 44 so that the combination pulley and fluid ring is mountable upon the shaft 27 extending from the rear of the drum 26. A plurality of spokes 46 extend radially from the hub to the pulley track 48 of the pulley 32.

In the operation of the washing machine 10, the motor 28 functions to rotate the drum 26 within the tub 22 via the pulleys 32, 38 and the pulley belt 36. If an unbalanced load of clothes develops within the drum 26, the fluid within the fluid chambers 40 moves to a position within the chambers opposite the unbalanced clothes load, thereby correcting or counterbalancing the distribution of the load relative to the bearings 31.

Figure 7:
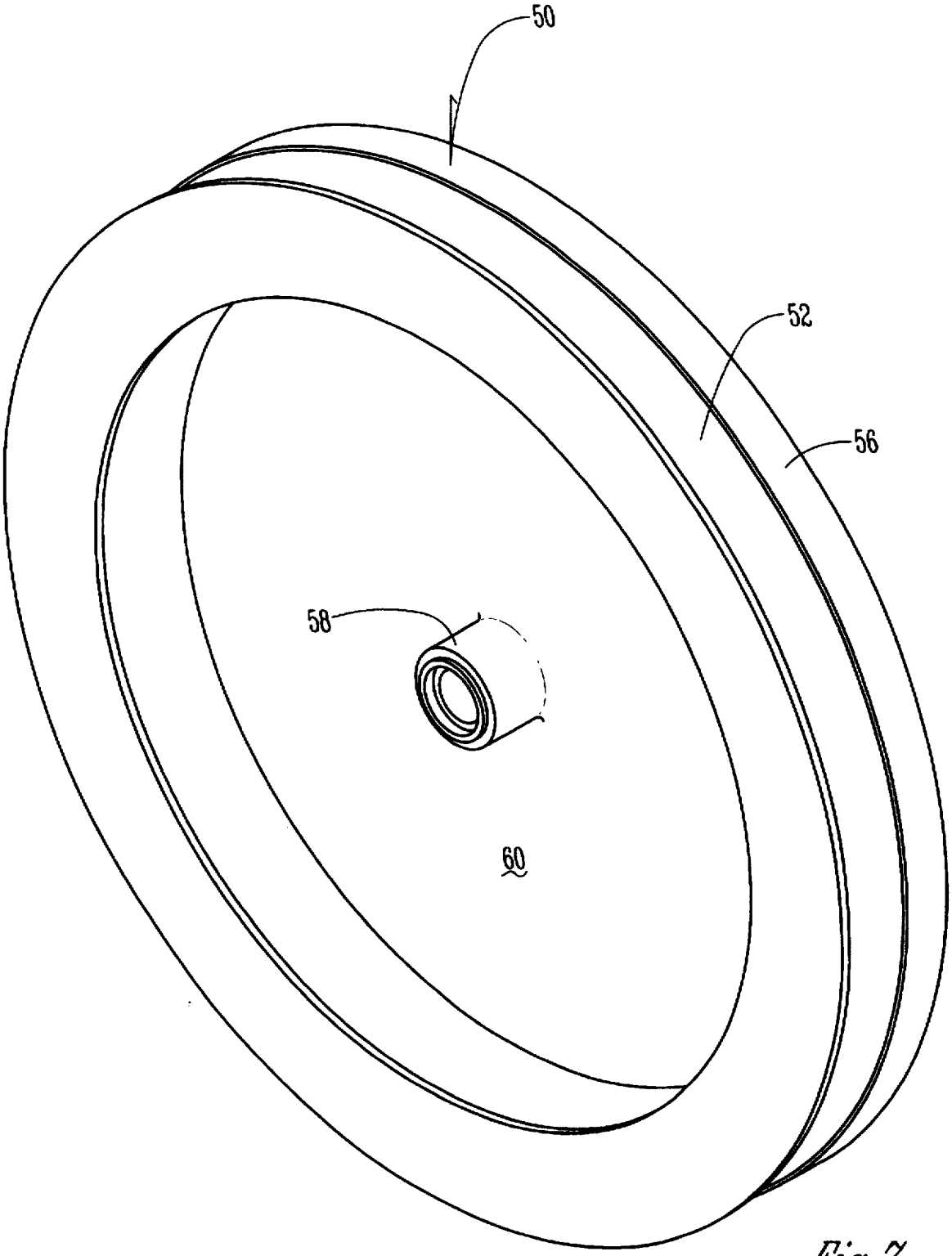
FIG. 7 is a perspective view of a second embodiment of the combined pulley and fluid ring of the present invention.
Figure 9:
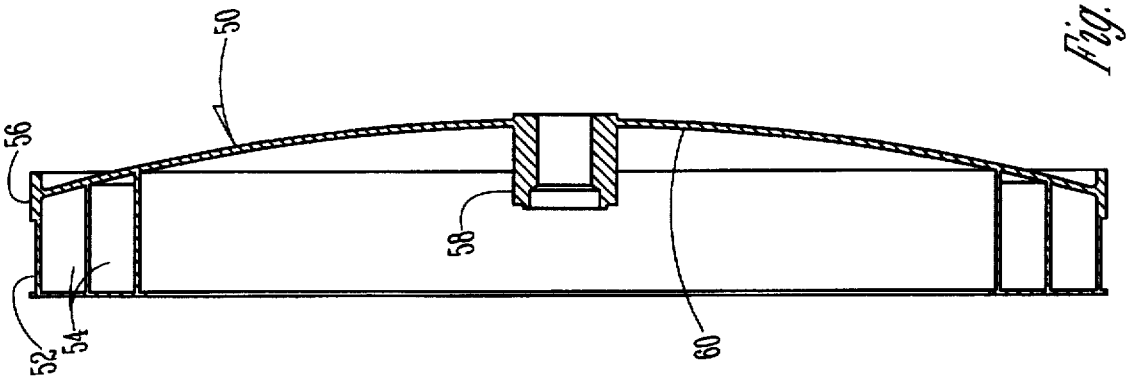
FIG. 9 is a sectional view taken along lines 9—9 of FIG. 8.
Figure 8:
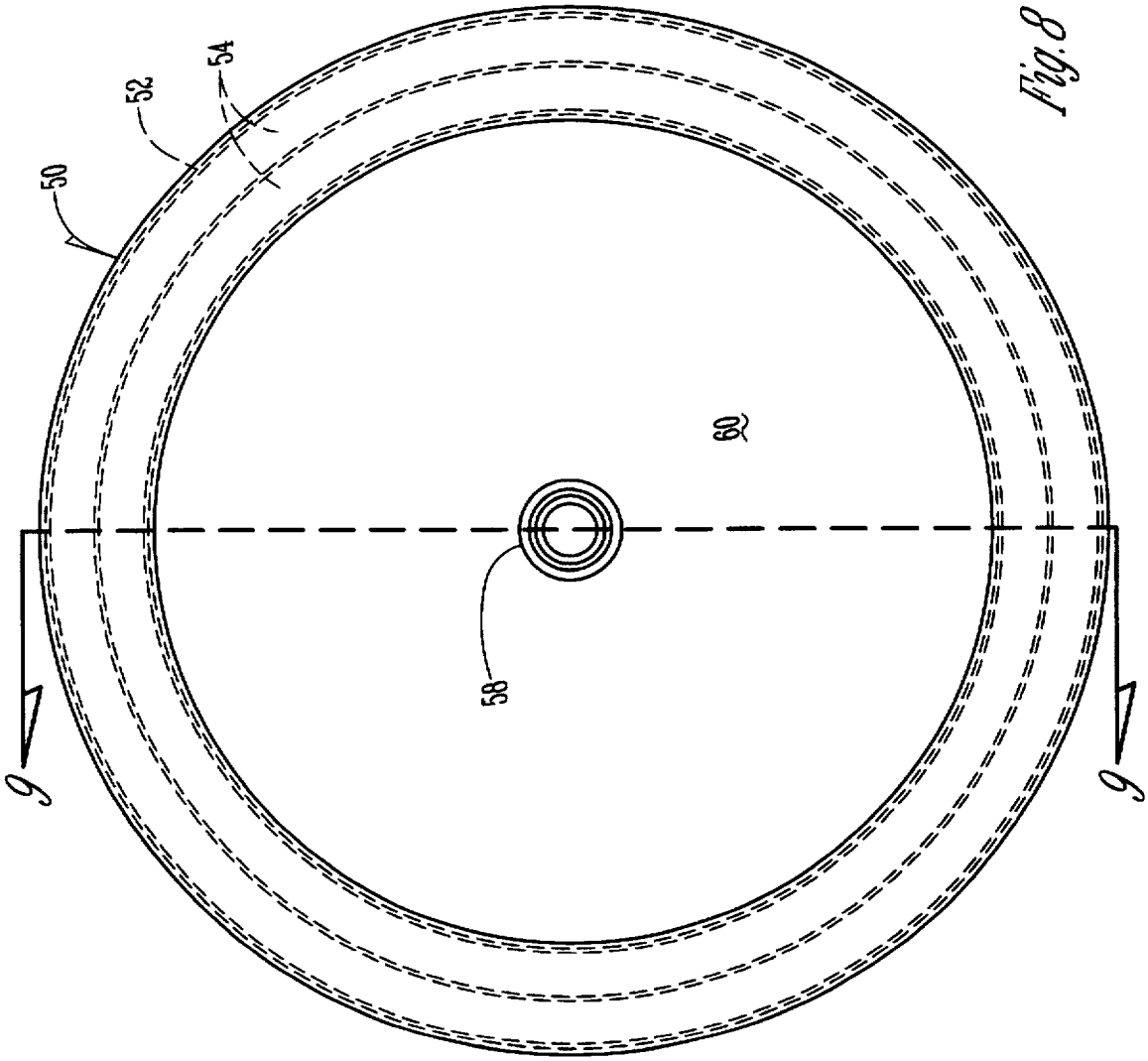
FIG. 8 is a front elevation view of the alternative embodiment.

In an alternative embodiment shown in FIG. 7, the pulley 50 has a large diameter and the fluid balance ring 52 is integrally formed within the circumference of the pulley 50. The ring 52 has concentric fluid chambers 54. With the ring 52 spaced radially inwardly from the pulley track 56, there is no interference with the belt 36. Also, the ring 52 is not cantilevered from the pulley 50, as in the first embodiment. A hub 58 is provided for mounting the combined pulley and ring to the support shaft 27. A disc wall 60 extends between the hub 58 and the belt track 56.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A clothes washing machine comprising:

a cabinet;

a tub supported in the cabinet;

a drum rotatably mounted within the tub and adapted to receive clothes to be washed;

a drum shaft extending axially from the drum and defining an axis of rotation for the drum;

a motor within the cabinet with a rotatable drive shaft extending from the motor;

a drive pulley mounted on the drive shaft;

a driven pulley mounted on the drum shaft;

a pulley belt trained about the drive pulley and the driven pulley for imparting rotation to the drum;

a fluid balance ring extending from the pulley.

2. The clothes washing machine of claim 1 wherein the fluid balance ring is formed integrally with the pulley.

3. The clothes washing machine of claim 1 wherein the fluid balance ring extends radially from the pulley.

4. The clothes washing machine of claim 1 wherein the fluid balance ring has a diameter greater than the diameter of the pulley.

5. The clothes washing machine of claim 1 wherein the fluid balance ring has a diameter smaller than the diameter of the pulley.

6. The clothes washing machine of claim 1 wherein the fluid balance ring extends axially from the pulley.

7. The clothes washing machine of claim 1 wherein the fluid balance ring includes multiple annular fluid chambers each being partially filled with fluid.

8. The clothes washing machine of claim 1 wherein the fluid balance ring includes a plurality of concentric annular chambers molded integrally with the pulley, and a lid sealably mounted over the chambers to retain fluid therein.

9. The clothes washing machine of claim 1 wherein the pulley has a belt track for engaging the pulley belt and the fluid balance ring is offset with respect to the belt track.

10. An improved clothes washer having a rotatable drum for receiving clothes to be washed and a drive motor for rotating the drum, the improvement comprising:

a pulley for operatively connecting the drive motor to the drum; and a fluid balance ring integrally formed with the pulley.

11. The improved clothes washer of claim 10 wherein the fluid balance ring extends axially and radially from the pulley.

12. The improved clothes washer of claim 10 wherein the fluid balance ring includes a plurality of concentric annular chambers each being partially filled with fluid.

13. The improved clothes washer of claim 10 wherein the fluid balance ring is located radially outward from the pulley.

14. The improved clothes washer of claim 10 wherein the fluid balance ring is located radially inwardly from the pulley.

15. A method of balancing an unbalanced load of clothes in a washing machine, the machine including a rotatable drum for holding the clothes being washed, a motor to rotate the drum, and a pulley to drivingly connect the motor and the drum, the method comprising:

extending a fluid balance ring from the pulley for rotation with the drum, the ring including at least one annular chamber; and partially filling the chamber with fluid whereby the fluid will counterbalance an unbalanced load during rotation of the drum and ring.

* * * * *